US005213524A

United States Patent [19]

Okamoto et al.

[11] Patent Number: 5,213,524

[45] Date of Patent: May 25, 1993

[54] SHIELD CONNECTOR

[75] Inventors: Hiroyuki Okamoto; Kunio Hoshino, both of Shizuoka, Japan

[73] Assignee: Yazaki Corporation, Japan

[21] Appl. No.: 879,354

[22] Filed: May 7, 1992

[30] Foreign Application Priority Data

Jun. 12, 1991 [JP] Japan ..... 3-43905[U]

[51] Int. Cl.[5] ..... H01R 13/648; H01R 13/66

[52] U.S. Cl. ..... 439/620; 439/108; 439/607

[58] Field of Search ..... 439/95, 108, 607, 620

[56] References Cited

U.S. PATENT DOCUMENTS 4,695,115 9/1987 Talend ..... 439/620 X 5,135,405 8/1992 Fusselman et al. ..... 439/108

FOREIGN PATENT DOCUMENTS 62-12279 1/1987 Japan .

0307676 12/1988 Japan ..... 439/95

*Primary Examiner*—Eugene F. Desmond

*Attorney, Agent, or Firm*—Wigman & Cohen

[57] ABSTRACT

A shield connector comprises a connector housing. A plurality of terminal pins having a bent section is supported by the connector housing. A cover is arranged to cover substantially the entirety of the terminal pins so as to shield a noise signal from the outside. The cover has a capacitor accommodating section. A capacitor is arranged within the capacitor accommodating section so as to support one ends of the respective terminal pins. An insulating section is so arranged as to cover an exterior of the capacitor. In a preferred embodiment, the cover has an upper cover element and a lower cover element. The insulating section is made of a resinous material.

3 Claims, 5 Drawing Sheets

SHIELD CONNECTOR

BACKGROUND OF THE INVENTION

This invention relates to a shield connector provided with a noise preventing capacitor.

In order to prevent noises from passing through a plurality of connector sections of an electronic instrument or the like via electric wires, it has conventionally been executed that the electric wires are connected to a shield case or the like grounded through a plurality of capacitors.

Such a construction or arrangement is shown in FIG. 1 of the attached drawings. That is, terminal pins 3 projecting from a connector housing 1 pass respectively through stepped tubular capacitors 5, and a box-shaped bracket 7 serving as a chassis plate is covered on the terminal pins 3. The tubular capacitors 5 have pairs of inner-surface electrodes 5*a* and outer-surface electrodes 5*b*, respectively, which are soldered to the terminal pins 3 and the bracket 7. Under this condition, the terminal pins 3 are bent substantially perpendicularly to form forward ends 3*a*, respectively, and the forward ends 3*a* are soldered to a wiring pattern on a printed circuit substrate 9.

In the above-described conventional shield connector, however, it is necessary that the terminal pins 3 pass respectively through the tubular capacitors 5 and, subsequently, the terminals pins 3 are bent substantially perpendicularly. An external force is applied to the tubular capacitors 5 when the terminal pins 3 are bent. Thus, there is a fear that cracks are developed in the tubular capacitors 5 and the latter is broken. Further, bending is liable to occur in the terminal pins 3.

Furthermore, in such conventional shield connector, since it is impossible to cut off noises entering into the terminal pins 3 forward from the tubular capacitors 5, a noise cutting-off characteristic is deteriorated.

As a solution of the above-described problems, there is known an arrangement illustrated in FIGS. 2 and 3, which is disclosed in, for example, Japanese Utility Model Laid-Open No. SHO 62-12279. The arrangement is such that stepped tubular capacitors 5 are fitted from the above respectively into fitting bores 13 which are formed in a metallic chassis plate 11 mounted on a rear surface of a connector housing 1, and a plurality of terminal pins 3 projecting in a manner of being bent substantially perpendicularly from the rear surface of the connector housing 1 are inserted respectively into the tubular capacitors 5. Each of the tubular capacitors 5 has a pair of inner-surface electrode 5*a* and outer-surface electrode 5*b* which are conducted in soldering respectively to the terminal pins 3 and the chassis plate 11. The tubular capacitors 5 fitted in and supported by the chassis plate 11 are supported from their upper surfaces by a support plate 15 which is mounted on the chassis plate 11. The support plate 15 has a heat resistance and an insulation. The terminal pins 3 pass respectively through the tubular capacitors 5 through through bores 17 which are formed in the support plate 15.

Accordingly, since the latter conventional example is arranged such that the tubular capacitors 5 are fitted about and mounted on the terminal pins 3, respectively, after having being bent, no excessive external force is applied to the tubular capacitors 5, and there is no fear that cracks are developed in the tubular capacitors 5. Moreover, since forward ends of the respective terminal pins 3 are supported by the tubular capacitors 5, respectively, which are supported by the metallic chassis plate 11 and the support plate 15, it is possible to prevent bending of the terminal pins 3 from occurring. Further, since the tubular capacitors 5 are provided respectively on the forward ends of the respective terminal pins 3, a noise cutting-off characteristic of the terminal pins 3 is improved as compared with the example illustrated in FIG. 1.

However, since the terminal pins 3 are exposed to the outside substantially along the entirely, the exposed portions are apt to receive signal noises from the outside. Thus, the noise cutting-off characteristic has still been insufficient. Furthermore, the environmental resistance cannot be said as being excellent.

SUMMARY OF THE INVENTION

It is therefore an object of the invention to provide a shield connector in which an attempt can be made to further improve a noise cutting-off characteristic and an environmental resistance, while restraining or suppressing bending of a plurality of terminal pins.

According to the invention, there is provided a shield connector comprising:

a connector housing;

a plurality of terminal pins supported by the connector housing and having respective bent sections thereof;

a cover member covering substantially the entirety of the terminal pins so as to shield a noise signal from the outside, the cover member having a capacitor accommodating section;

a capacitor arranged within the capacitor accommodating section and supporting one ends of the respective terminal pins; and an insulating section so arranged as to cover an exterior of the capacitor.

With the arrangement of the invention, since the substantially entirety of the terminal pins which project toward the connector housing is covered with the cover member, there can be provided the shield connector which is higher in noise cutting-off characteristic.

Further, since the terminal pins are supported by the lower cover, bending of the terminal pins can also be restrained.

DETAILED DESCRIPTION OF THE PREFERRED EMBODIMENTS

The invention will hereunder be described with reference to an embodiment illustrated in FIGS. 4 through 9.

Figure 4:
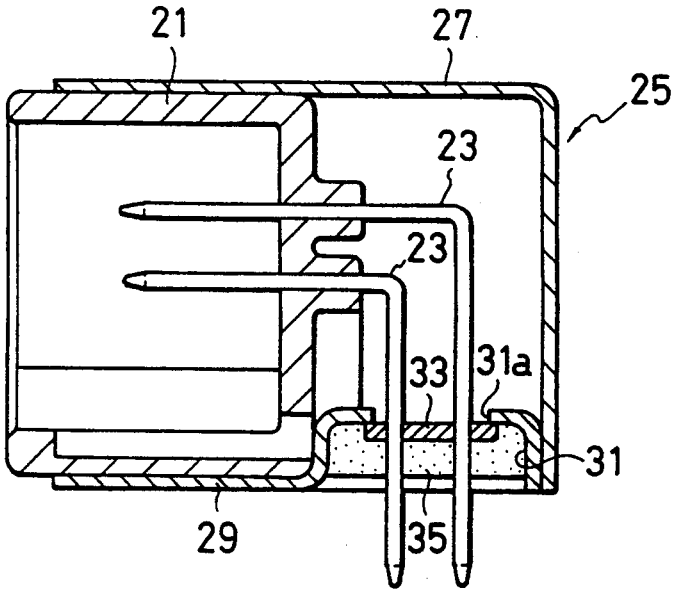
FIG. 4 is a cross-sectional view showing the entire arrangement of an embodiment according to the invention.
Figure 5:
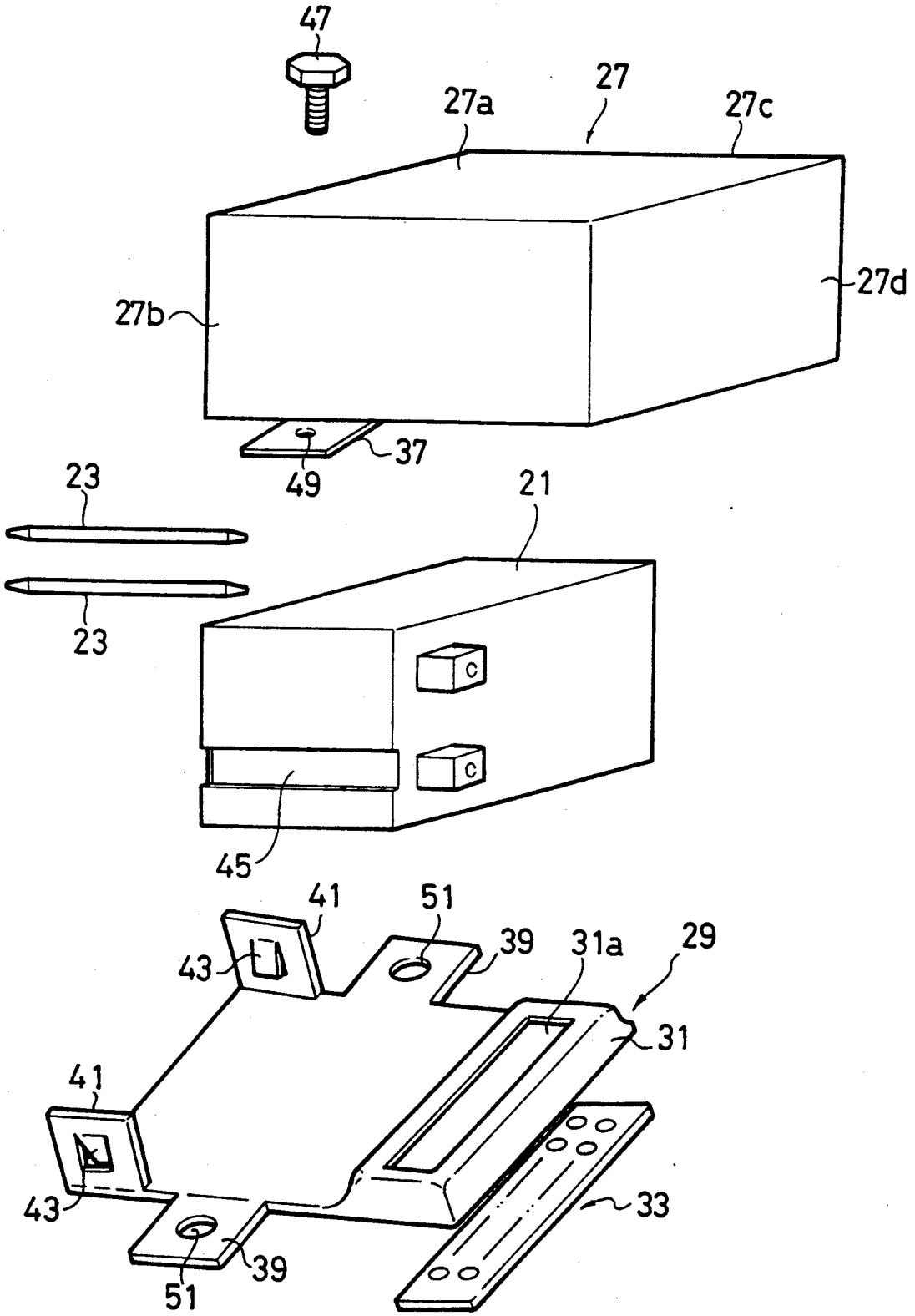
FIG. 5 is an exploded perspective view of the embodiment illustrated in FIG. 4.
Figure 6:
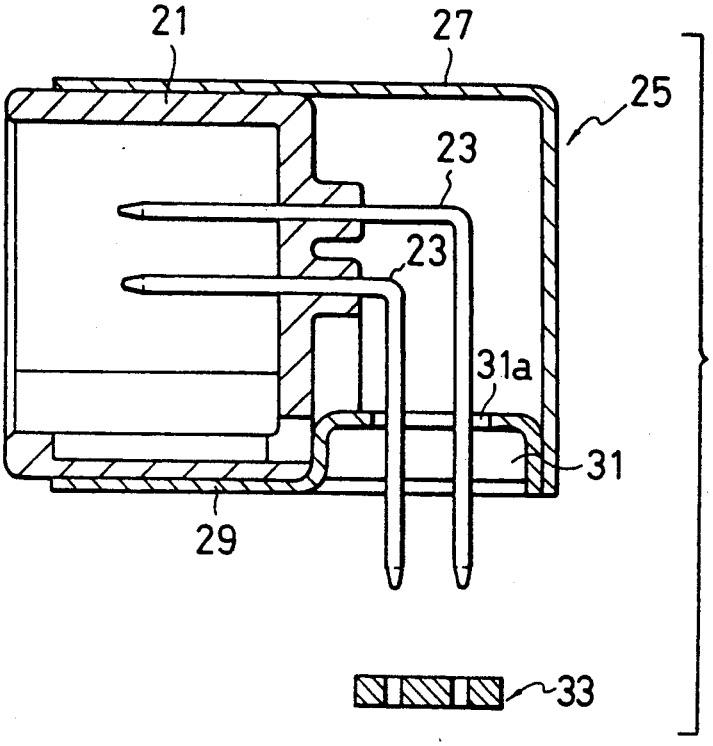
FIG. 6 is a cross-sectional view showing a condition under which a cover is mounted on a connector housing.
Figure 7:
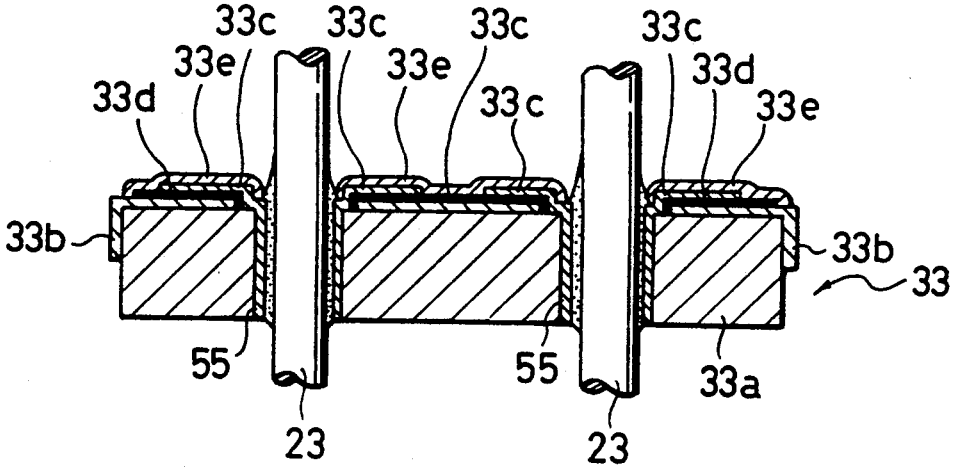
FIG. 7 is a cross-sectional view showing a capacitor.
Figure 8:
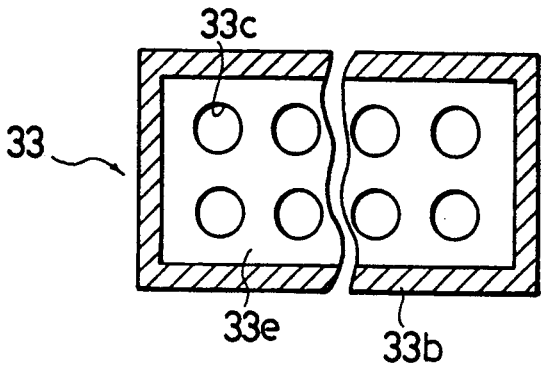
FIG. 8 is an upper plan view of the capacitors illustrated in FIG. 7.
Figure 9:
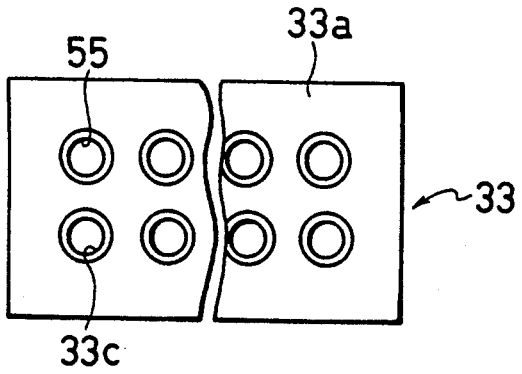
FIG. 9 is a lower plan view of the capacitors illustrated in FIGS. 7 and 8.

Referring first to FIGS. 4 through 9, there is shown the entire arrangement of an embodiment according to the invention. Specifically, FIG. 4 is a cross-sectional view showing the entire arrangement of the embodiment. FIG. 5 is an exploded perspective view showing the entire arrangement of the embodiment. FIG. 6 is a cross-sectional view showing a condition under which a cover is mounted on a connector housing. FIG. 7 is a cross-sectional view showing a capacitor. FIG. 8 is an upper plan view of the capacitor. FIG. 9 is a lower plan view of the capacitors illustrated in FIG. 8.

As shown in FIG. 4, a connector housing 21 made of a material having a heat resistance and an insulation has a rear surface on which a plurality of terminal pins 23 are mounted in vertical two rows. The terminal pins 23 are arranged such that terminal pins 23 are beforehand bent substantially perpendicularly downwardly respectively from the intermediate portions of the respective terminal pins 23, to form downward pins which are arranged in front and rear two (2) rows.

The connector housing 21 has the rear surface on which a box-like cover 25 is mounted. The box-like cover 25 serves as a metallic chassis plate which covers substantially the entirety of the terminal pins 23. The cover 25 is so arranged as to prevent a noise signal from the outside from reaching the terminal pins 23.

The cover 25 is so formed as to be divided into two (2) including an upper cover element 27 and a lower cover element 29. A capacitor accommodating section 31 is formed in the lower cover element 29.

A capacitor 33 formed as a filter element is received or accommodated in the capacitor accommodating section 31. The connector pins 23 pass through the capacitor 33 and are exposed to the outside. Further, the capacitor accommodating section 31 is filled with a material 35 having an insulation such as resin or the like. The insulating material 35 is so arranged as to cover the exterior of the capacitor 33.

As shown in FIG. 5, the upper cover element 27 is formed into a box-like configuration having an upper surface 27*a*, both left- and right-hand side surfaces 27*b* and 27*c* and a rear surface 27*d*. The both left- and right-hand side surfaces 27*b* and 27*c* have respective lower edges thereof on which a pair of left- and right-hand flanges 37 serving as joining sections are provided in projection laterally.

As shown in FIG. 5, the lower cover element 29 is provided for closing a lower opening portion of the upper cover element 27. The lower cover element 29 has a rear portion thereof on which the capacitor accommodating section 31 is formed. The capacitor accommodating section 31 has an upper surface in which an opening 31*a* is formed into which the terminal pins 23 are capable of being inserted. Further, the lower cover element 29 has a front portion thereof on which a pair of left- and right-hand flanges 39 are provided in projection laterally. The pair of left- and right-hand flanges 39 cooperate respectively with the flanges 37 of the upper cover element 27 to form joining sections. Further, the lower cover element 29 has a front end portion thereof at which a pair of left- and right-hand engaging sections 41 are provided in an upstanding and bending manner. A pair of lock pawls 43 are provided respectively on the engaging sections 41 so as to project inwardly. The lock pawls 43 are fitted in and engaged with recessed grooves 45, respectively, which are formed in the both left- and right-hand surfaces of a connector housing 21, whereby the lock pawls 43 are fixedly mounted on the connector housing 21.

Bolt bores 49 and 51, through which bolts 47 pass, are formed in the flanges 37 of the upper cover element 27 and the flanges 39 of the lower cover element 29, respectively. The upper cover element 27 is combined with the lower cover element 29 which is fixedly mounted on the connector housing 21, and the flanges 37 and 39 are fastened by the bolts 47 which pass through the both bolt bores 49 and 51, whereby the upper cover element 27 and the lower cover element 29 are connected to each other, to form the box-like cover 25. After assembling, the forward ends of the respective terminal pins 23 are supported by the lower cover element 29.

As shown in FIGS. 7 to 9, the capacitor 33 is formed as a filter element.

Specifically, as shown in FIGS. 7 to 9, the capacitor 33 is arranged such that a plurality of through bores 55 coincident in pitch with the terminal pins 23 are formed by thick-film printing technique, in an alumina substrate 33*a*, a common electrode 33*b* and a plurality of individual electrodes 33*c* are formed, a dielectric substance 33*d* is formed at a location between the both electrodes 33*b* and 33*c*, and an upper surface of the capacitor 33 is covered with an insulating layer 33*e*.

An assembling step of the shield connector will next be described.

First, the plurality of pins 23 are inserted into the connector housing 21. The terminal pins 23 are bent substantially perpendicularly downwardly from their respective half or intermediate portions to form downward pins arranged in front and rear (2) rows.

Subsequently, the lock pawls 43 of the lower cover element 29 are fitted into and engaged with the recessed grooves 45 in the connector housing 21, respectively, so as to be fixedly mounted thereto.

Subsequently, the capacitor 33 is arranged such that the terminal pins 23 are inserted respectively into the through bores 55. The capacitor 33 is accommodated or received in the capacitor accommodating section 31 in the lower cover 29, to close the opening 31*a*. The individual electrodes 33*c* and the terminal pins 23, and the common electrode 33*b* and the capacitor accommodating section 31 are conducted to teach other, respectively, by soldering or the like.

Further, the insulating material 35 is filled within the capacitor accommodating section 31 from the lower surface of the capacitor 33, as illustrated in FIG. 4.

Figure 1:
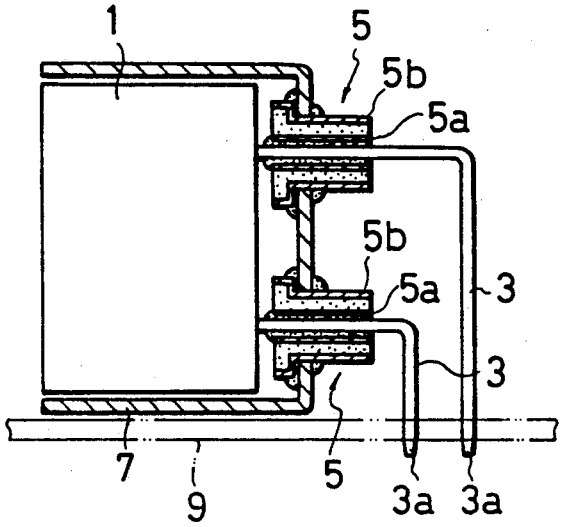
FIG. 1 PRIOR ART
FIG. 1 is a cross-sectional view showing a conventional example.
Figure 2:
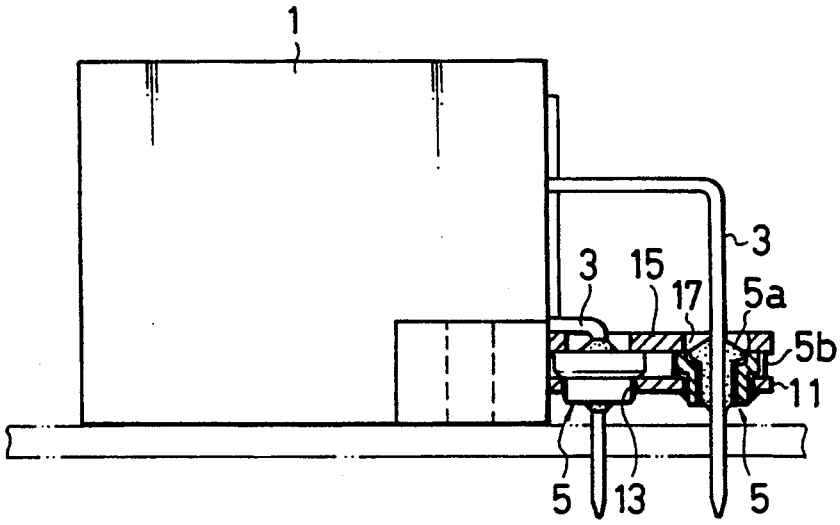
FIG. 2 PRIOR ART
FIG. 2 is a partially cut-away, side elevational view showing another conventional example.
Figure 3:
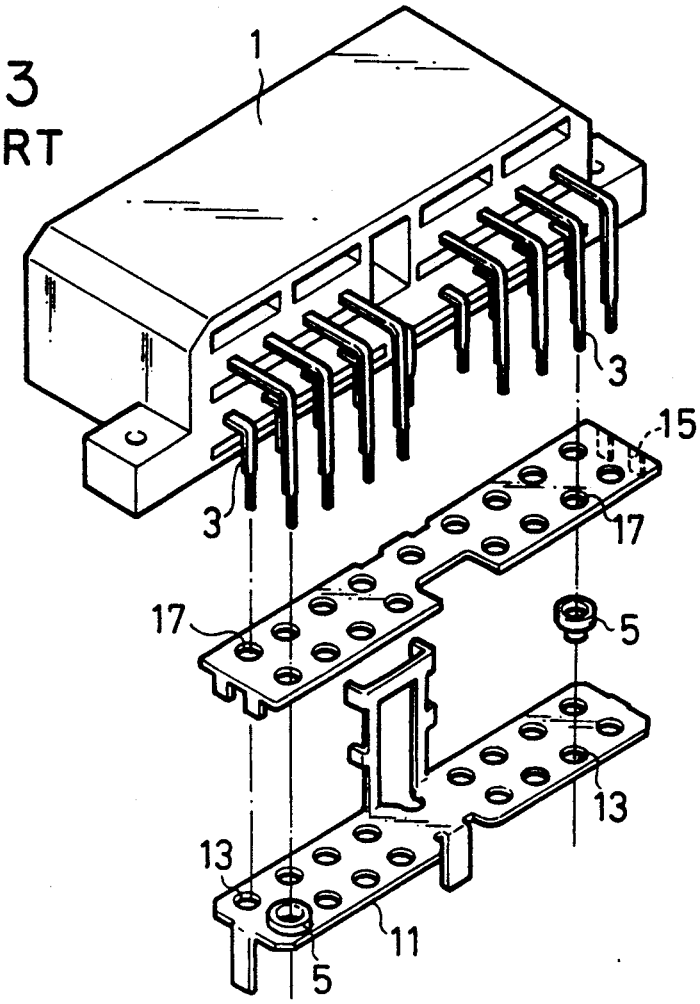
FIG. 3 PRIOR ART
FIG. 3 is an exploded perspective view of FIG. 2.

After hardening or curing of the insulating material 35, the upper cover element 27 is combined with the lower cover element 29. The bolts 47 are inserted into the bolt bores 49 and 51 in the respective flanges 37 and 39. The bolts 47 are fastened to the printed circuit substrate (refer to FIG. 1) to connect both to each other, thereby forming the box-like cover 25, as shown in FIG. 4. In this connection, a joint or seam between the upper cover element 27 and the lower cover element 29 is jointed by welding or the like. It is possible to join the upper cover element 27 and the lower cover element 29 to each other only by welding. In this case, a welded location forms a joining portion.

In the manner described above, the embodiment is arranged such that the lower cover element 29 functions as the support plate, and the forward ends of the respective terminal pins 23 are supported by the lower cover element 29. Thus, it is restrained to bend the terminal pins 23. Since substantially the entirety of the terminal pins 23 is shielded from a noise signal by the metallic cover 25, a noise cutting-off characteristic is further improved. Since the capacitor 33 is arranged integrally or unitedly as a filter element, assembling is facilitated so that assembling steps are reduced and an attempt can be made for miniaturization. Since the capacitor 33 is sealed by the insulating material 35 such as resin or the like, an environment resistance characteristic is improved.

What is claimed is:

1. A shield connector comprising:

a connector housing;

a plurality of terminal pins supported by said connector housing and having respective bent sections thereof;

a cover member covering substantially the entirety of said terminal pins so as to shield a noise signal from the outside, said cover member having a capacitor accommodating section;

a capacitor arranged within said capacitor accommodating section and supporting one ends of the respective terminal pins; and an insulating section so arranged as to cover an exterior of said capacitor.

2. A shield connector according to claim 1, wherein said cover member has an upper cover element and a lower cover element, wherein said lower cover element has said capacitor accommodating section, said capacitor accommodating section having an opening, and wherein said capacitor is so arranged as to close said opening.

3. A shield connector according to claim 1, wherein said insulating section is made of a resinous material, and is filled in said capacitor accommodating section.

* * * * *